US010214267B2

(12) United States Patent
Robertson et al.

(10) Patent No.: US 10,214,267 B2
(45) Date of Patent: Feb. 26, 2019

(54) WATERCRAFT

(71) Applicant: Confluence Outdoor, LLC, Greenville, SC (US)

(72) Inventors: Mark Robertson, Greenville, SC (US); Hans Nutz, Greenville, SC (US)

(73) Assignee: Confluence Outdoor, LLC, Greenville, SC (US)

( * ) Notice: Subject to any disclaimer, the term of this patent is extended or adjusted under 35 U.S.C. 154(b) by 0 days.

(21) Appl. No.: 15/664,644

(22) Filed: Jul. 31, 2017

(65) Prior Publication Data

US 2019/0031303 A1 Jan. 31, 2019

(51) Int. Cl.

*B63B 35/71* (2006.01)
*B63B 7/04* (2006.01)
*B63B 35/79* (2006.01)

(52) U.S. Cl.

CPC ..... *B63B 35/71* (2013.01); *B63B 7/04* (2013.01); *B63B 35/7909* (2013.01)

(58) Field of Classification Search

CPC ..... B63B 35/00; B63B 35/34; B63B 35/71; B63B 7/00; B63B 7/04; B63B 43/00; B63B 43/14; B63B 1/00; B63B 1/04; B63B 1/042; B63B 1/12; B63B 7/06

USPC ..... 114/347

See application file for complete search history.

(56) References Cited

U.S. PATENT DOCUMENTS 4,660,490 A 4/1987 Broadhurst
4,710,143 A 12/1987 Boulanger
4,730,568 A 3/1988 Campbell
5,127,862 A 7/1992 Pia
5,209,178 A 5/1993 Rowe
5,325,806 A 7/1994 Lee
5,964,177 A * 10/1999 Niemier ..... B63B 35/71 114/347
D416,598 S 11/1999 Gendron
D427,136 S 6/2000 Roy et al.
6,112,692 A 9/2000 Lekhtman
6,880,481 B2 4/2005 Dunn et al.
7,021,234 B1 4/2006 Belyeu
7,121,225 B1 10/2006 Caples
7,320,291 B2 1/2008 Eckert
D769,176 S 10/2016 Monroe
9,643,696 B1 5/2017 Lockhart et al.
2004/0255836 A1* 12/2004 Hopkins ..... B63B 35/71 114/347

(Continued)

OTHER PUBLICATIONS

Malibu Kayaks 3.4 Speed Surfing Kayak, http://malibukayaks.com/kayaks/3-4, known at least as early as Jul. 11, 2017, 5 pgs.

(Continued)

*Primary Examiner* — Lars A Olson
(74) *Attorney, Agent, or Firm* — Douglas Kim Law Firm, LLC; Douglas W. Kim

(57) ABSTRACT

A watercraft is described that has a shell with a bottom hull, a top deck, a bow, and a stern. A storage compartment is integrally formed with the top deck of the shell. A seating area is provided above the storage compartment. A first standing zone is formed on the top deck adjacent to the seating area and located toward the bow relative to the seating area. The first standing zone defines a first plane. The first standing zone is not a floor of a well. The seating area is raised relative to the first plane.

17 Claims, 6 Drawing Sheets

(56) References Cited

U.S. PATENT DOCUMENTS

| | | | | |
|---|---|---|---|---|
| 2006/0254495 | A1* | 11/2006 | Eckert | B63B 35/71 114/347 |
| 2011/0114007 | A1 | 5/2011 | Flemons | |
| 2014/0199903 | A1 | 7/2014 | Grimes et al. | |
| 2015/0059637 | A1 | 3/2015 | Johns et al. | |

OTHER PUBLICATIONS

Ocean Kayak Nalu 11, https://www.oceankayak.com/productDetail.aspx?id=2948, known at least as early as Jul. 11, 2017, 2 pgs.
Malibu Kayaks Trio, http://malibukayaks.com/kayaks/trio-11, known at least as early as Jul. 11, 2017, 4 pgs.
Kaku Kayak Kahuna, http://kakukayak.com/#, known at least as early as Jul. 11, 2017, 5 pgs.
Malibu Kayaks Express, http://malibukayaks.com/kayaks/express, known at least as early as Jul. 11, 2017, 3 pgs.
Diablo Paddlesports, Stand-up Paddle Kayaks and Accessories, http://diablopaddlesports.com/, known at least as early as Jul. 11, 2017, 5 pgs.
Malibu Kayaks Mini-X, http://malibukayaks.com/kayaks/mini-x, known at least as early as Jul. 11, 2017, 5 pgs.
Malibu Kayaks X-Caliber, http://malibukayaks.com/kayaks/x-caliber, known at least as early as Jul. 11, 2017, 5 pgs.
Native Watercraft, Versa Board Angler, http://nativewatercraft.com/product/versaboard/, known at least as early as Jul. 11, 2017, 3 pgs.
Malibu Kayaks, Recreational Kayaks, http://malibukayaks.com/kayaks/recreational, known at least as early as Jul. 11, 2017, 28 pgs.
Native Versa Board Cooler Seat, http://www.austinkayak.com/products/7971/Native-Versa-Board-Cooler-Seat.html, known at least as early as Jul. 11, 2017, 2 pgs.
Imagine Surf Angler, http://www.imaginesurf.com, known at least as early as Jul. 11, 2017, 6 pgs.

* cited by examiner

WATERCRAFT

FIELD OF DISCLOSURE

The present disclosure relates to watercraft that may be manually powered, though small motors are sometimes used. Watercraft according to the present disclosure may be the types including, but are not limited to, kayaks, canoes, and stand up paddle boards.

BACKGROUND

Watercraft designers always have faced a range of differing customer needs. Kayak and board designers in particular, typically diverge in many respects.

Kayak manufacturers continue to develop products to suit the needs of their customers. Various segments of customers have widely differing needs and intended uses when looking to purchase a kayak or other watercraft. Whitewater enthusiasts typically prefer a shorter, maneuverable sit-inside kayak. Users in the ocean or other open water typically prefer a longer sit-inside design. Dedicated kayak fisherman, on the other hand, often prefer sit-on-top kayaks designed specifically to store or hold the large assortment of equipment necessary for successful fishing.

Board manufacturers have similarly continued to develop product to suit the needs of their customers. Surf boards, for example, are designed for buoyancy on top of a moving wave. To expand their customer base, board manufactures have increased the width and length of traditional surfboards to produce significant additional buoyancy and stability. These products are often referred to as stand up paddle boards. These stand up paddle boards are designed to support an individual even when stationary on flat water. Compared to surf boards, the added width of stand up paddle boards provide increased stability to allow users to paddle while standing.

The present disclosure provides a watercraft that seeks to further the versatility of watercraft design to encourage even more participants in watersports without having to purchase multiple products.

SUMMARY

One embodiment of the present disclosure includes a watercraft comprising a shell. The shell has a bottom hull, a top deck, a bow, and a stern. A storage compartment is integrally formed with the top deck of the shell. A seating area is provided above the storage compartment. A first standing zone is formed on the top deck adjacent to the seating area and located toward the bow relative to the seating area. The first standing zone defines a first plane. The first standing zone is not a floor of a well. The seating area is raised relative to the first plane.

Another embodiment of the present disclosure includes a kayak comprising a substantially hollow shell. The shell has a bottom hull, a top deck, a bow, and a stern. A storage compartment is integrally formed on the top deck of the shell substantially rearward of a midline between the bow and the stern. A top surface of the storage compartment is configured for use as a seat. The top surface of the storage compartment is located above a lowest point of a gunwale of the kayak.

A further embodiment of the present disclosure includes a kayak comprising a shell. The shell has a bottom hull, a top deck, a bow and a stern. At least a portion of a storage compartment is integrally formed on the top deck of the shell. A top surface of the storage compartment is capable of use as a seat. The top deck comprises one or more standing zones, wherein with respect to a top view of the kayak, a total area of the one or more standing zones comprises at least 50% of a footprint of the top deck. The one or more standing zones define one or more planes respectively. The top surface of the storage compartment is offset higher than each of the respective planes of the one or more standing zones.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

FIGS. 1-5 illustrate an embodiment of a watercraft 10 according to embodiments of the present disclosure. As used herein, the term "watercraft" is used broadly to include both boats, such as kayaks and canoes, as well as boards used for riding on the water, such as surf boards and stand up paddle boards.

The watercraft 10 of the present disclosure may be informally referred to as a hybrid or crossover design that seeks to provide versatility to a user by providing a unique combination of features from stand up paddle boards (SUPs) and kayaks. The inventors have studied users of SUPs and found that many users do not use the SUP in a standing position at all times. While relatively stable and unlikely to capsize, the act of standing on a SUP for an extended period of time requires significant balance and core strength that places some strain on the user's muscles. Therefore, one aspect of the watercraft 10 of the present disclosure is the provision of a seating area 12 integrated with the watercraft and raised relative to the one or more standing zones 14 provided on the watercraft.

Figure 5:
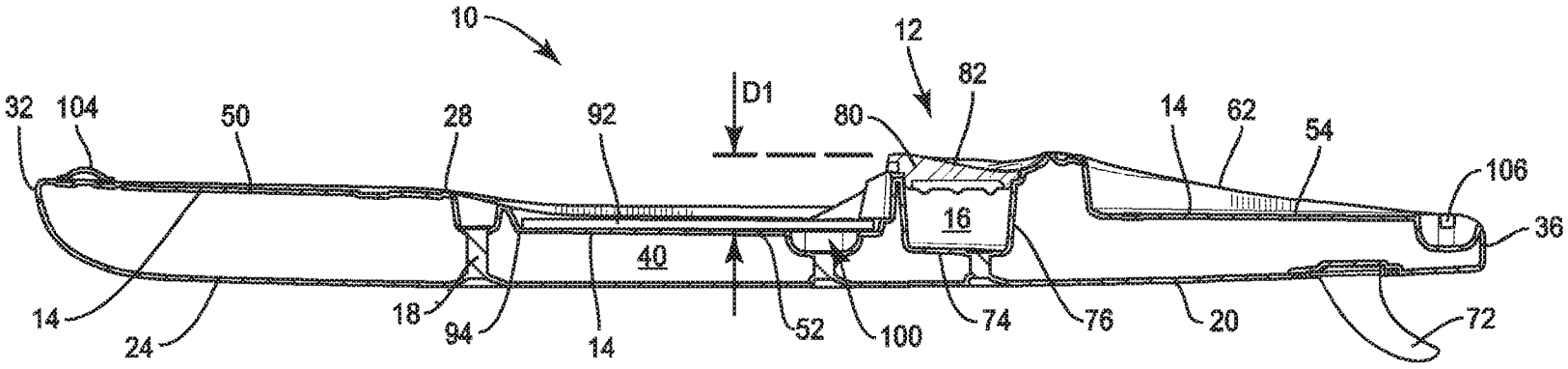
FIG. 5 is a cross sectional view of the watercraft of FIG. 1 along line C in FIG. 3.

The watercraft 10 makes use of the seating area 12 to package an integral storage compartment 16 (also shown in FIG. 5). The integral storage compartment 16 provides a fully or partially enclosed receptacle for retaining personal items without having to separately tie down or otherwise mount storage, such as coolers, onto the watercraft 10. The storage compartment 16 may provide dry storage or may include a closeable scupper or drain so that the storage compartment may function as a live well for fish. The storage compartment 16 is an enhancement over traditional SUPs, where the user must hold personal items on their body, leave them behind on the bank, separately attach them to the board, or otherwise risk these items falling into the water.

Figure 1:
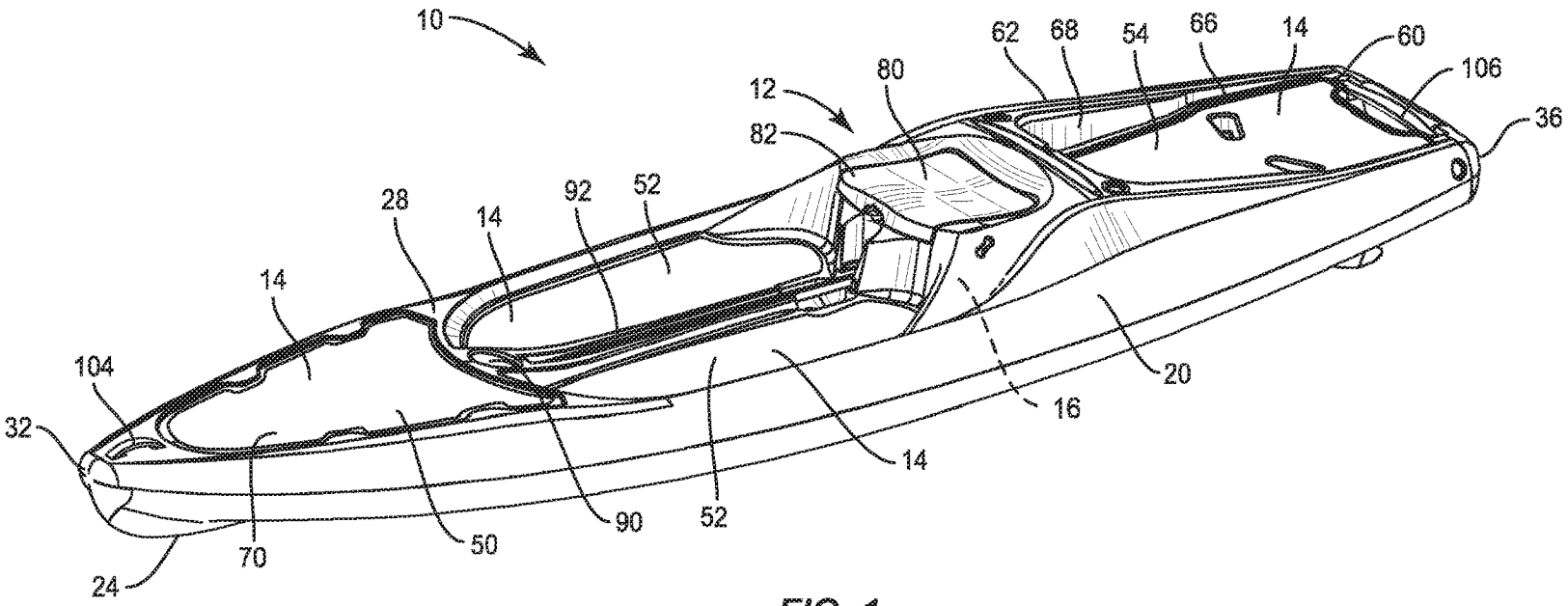
FIG. 1 is a top perspective view of an embodiment of a watercraft according to the present disclosure.
Figure 2:
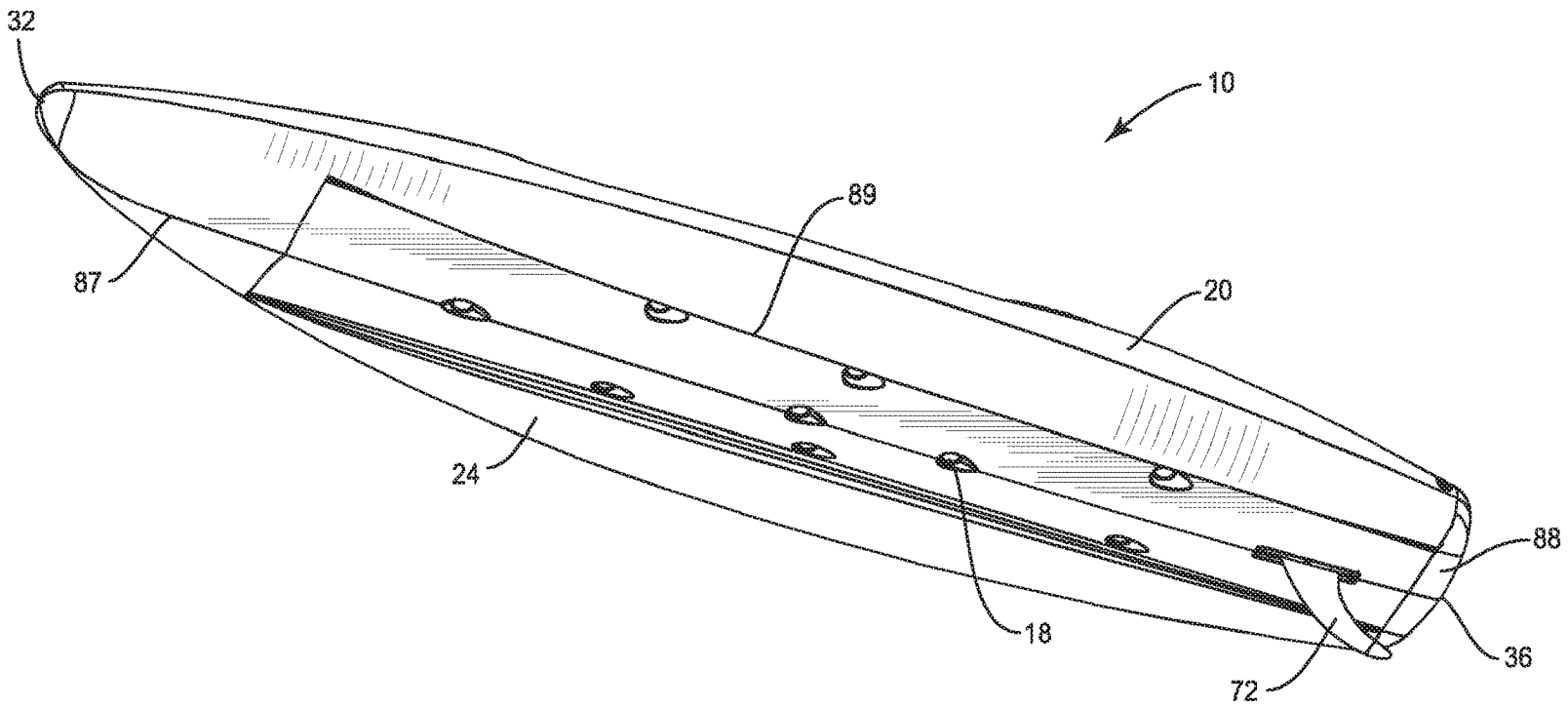
FIG. 2 is a bottom perspective view of the watercraft of FIG. 1.

The inventors have also studied the manufacturing methods of SUPs, which typically involve use of a core and a skin of several layers of material, such as fiberglass. The inventors have determined that by using a rotomolding process, their watercraft 10 can be made highly durable in a cost effective manner. When employing a rotomolding process, strength and weight are often competing factors. To minimize weight, a rotomolded product typically remains substantially hollow. When the product is hollow, however, strength must be provided structurally using ribs or other changes in surface contour. For this reason, the watercraft 10 has significant contour along the top and bottom thereof, as shown in FIGS. 1 and 2, in comparison to a typical SUP, which may have a substantially continuous top and bottom surfaces.

The watercraft 10 of the present embodiment includes at least one scupper 18 (FIG. 2), which may be plugged during final assembly, to further add structural integrity. Alternatively, if the watercraft is filled with foam or other material for strength, the weight of the watercraft would increase, but a more continuous contour may be used for the top and bottom of the watercraft.

As shown in FIGS. 1-5, the watercraft 10 includes a shell 20 that includes a bottom hull 24, a top deck 28, a front end 32, also called a bow, and a rear end 36, also called a stern. As seen in FIG. 5, and described above, the shell 20 may be formed from a rotomolding process to simultaneously form the bottom hull 24 and the top deck 28 as a single piece, and produce a substantially hollow interior cavity 40. In an alternative embodiment, the bottom hull 24 and the top deck 28 may be separately molded and fused together. In the illustrated embodiment, scuppers 18 are formed from the bottom hull 24 to the top deck 28 to add structural strength to the shell 20. The scuppers 18 are permanently capped or plugged with foam or other material in the current embodiment, but one or more of the scuppers could be left open or used with a removable plug to allow for water drainage.

Figure 3:
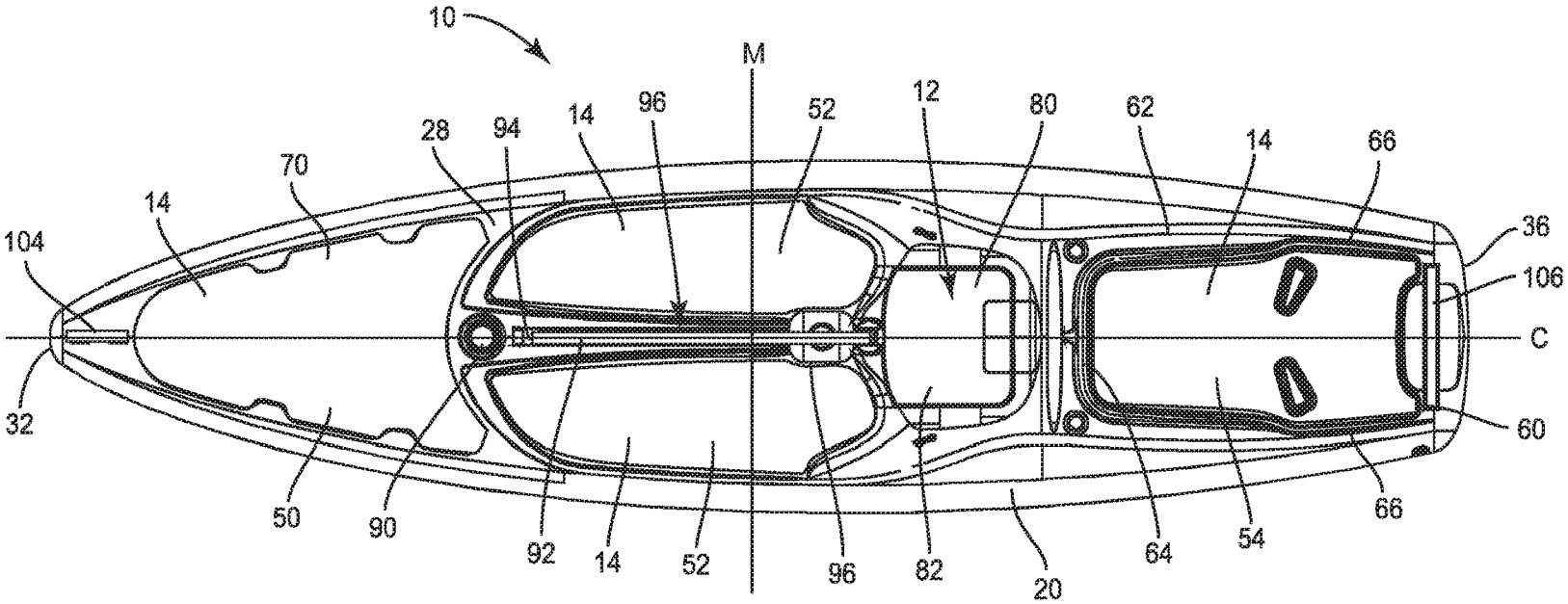
FIG. 3 is a top view of the watercraft of FIG. 1.

As shown in FIG. 3, an imaginary centerline C bisects the shell 20 along the bow-to-stern direction between the front end 32 and the rear end 36. An imaginary midline M is perpendicular to the centerline C and bisects the shell 20 between the front end 32 and the rear end 36.

As discussed above, one aspect of an embodiment of the watercraft 10 is to provide a significant portion of the top deck 28 suitable for the user to stand on. In the illustrated embodiment, the top deck 28 includes four standing zones 14: a bow standing zone 50, a pair of mid-ship standing zones 52, and a stern standing zone 54. As used herein, a "standing zone" is a substantially planar, substantially continuous section of the top deck 28 having an area of at least three inches by eleven inches, e.g. suitable for the comfortable placement of at least one foot of an adult user.

FIG. 3 shows a top view of the watercraft 10. From this view, the outline of the watercraft 10 may be defined as the footprint of the watercraft. In one embodiment, the total combined area of the standing zones 14 accounts for at least 30% and preferably at least 50% of the total area of the footprint of the watercraft.

In one embodiment, none of the standing zones 14 provide a floor of a well. As used herein, a "well" is defined as an open-top recessed area of the top deck 28 having a floor, where the floor is substantially completely surrounded on each of its peripheral sides by a wall having a height of at least three inches. Kayaks often include wells, such as foot wells, used to provide a place for the user to brace their feet when standing, or as a point of leverage during seated paddling. Sit-on-top kayaks often similarly include tank wells for securely locating gear, such as live tanks.

The stern standing zone 54 may be uniquely designed for possible use in a plurality of ways. As shown in FIGS. 1 and 3, the rear edge 60 of the stern standing zone 54 may be substantially level with a corresponding portion of the gunwale 62 of the watercraft 10. This configuration is reminiscent of a swim deck sometimes found on the stern of inboard motor boats.

The forward edge 64 and side edges 66 of the stern standing zone 54 may be bordered by upstanding walls 68 (FIG. 1). The upstanding walls 68 allow the stern standing zone 54 to double as a pseudo tank well for staging additional storage, such as a cooler.

In one embodiment, one or more of the standing zones 14 may be provided with a traction pad 70 (FIG. 1) applied to the top deck 28 of the shell 20. In other embodiments, the surface of one or more of the standing zones 14 may be roughened to provide additional traction for the user.

Figure 4:
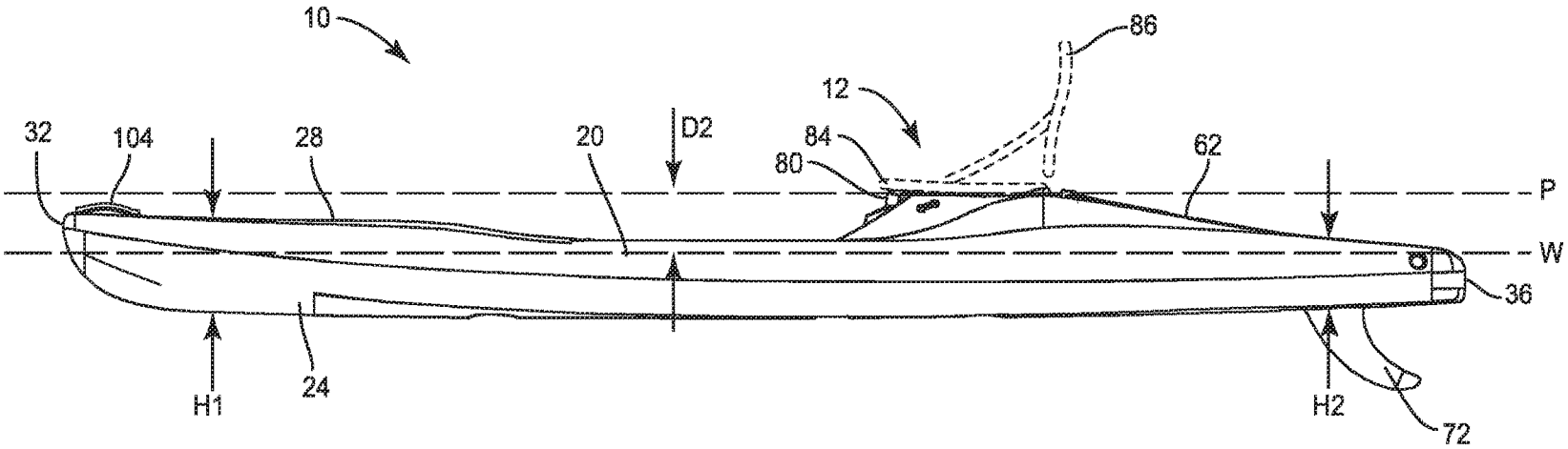
FIG. 4 is a side view of the watercraft of FIG. 1.

The significant proportion of standing zones 14 along the top deck 28 provides the watercraft 10 with an appearance of a SUP. As shown in FIG. 4, the low profile of the watercraft 10 also contributes to its comparison to a SUP versus a kayak. Traditional kayaks have an average height of their shell of about twelve to about sixteen inches. In one embodiment, the maximum height of the illustrated watercraft 10, excluding the seating area 12 may be less than twelve inches. A "low profile" of the watercraft 10, if present, may be alternatively defined by the height of the shell 20 at or near specific locations along the bow-to-stern direction. For example, a watercraft 10 may be defined to have a low profile if the height of the shell 20 is less than or equal to ten inches at at least two locations, specifically twelve inches inward of the front end 32 and twelve inches inward of the rear end 36. See, for example, height locations H1 and H2 in FIG. 4. The height of the shell is to determined based upon a side plan view as provided in FIG. 4. The watercraft 10 is not necessarily low profile in all embodiments. One skilled in the art will also appreciate that the absolute dimensions may change as the watercraft 10 is scaled down for younger or smaller users or the watercraft is scaled up for user's that require larger weight capacities for themselves or their equipment.

The maximum width of the watercraft 10, see FIG. 3, may also be similar to that of a SUP. A width of at least 32 inches can provide a relatively stable platform on which the user may stand. The absolute width of the watercraft 10 may decrease for younger or smaller intended users without significantly impacting the overall stability of the watercraft. Another feature of some SUPs that may be incorporated into the watercraft 10 of the present disclosure is a fin 72 (FIG. 4), which may be removably attached to the bottom hull 24, preferably without requiring the user to employ any tools.

The fin 72 provides additional tracking that helps to lock the watercraft in and course correct for directional efficiency.

Separating the watercraft 10 from a traditional SUP, the seating area 12 and integral storage compartment 16 may be best illustrated by FIG. 5. The storage compartment 16 is an enclosure accessible to the user in or below the seating area 12. In the illustrated embodiment, the storage compartment includes a molded floor 74 separated from the bottom hull 24 by a portion of the interior cavity 40. The storage compartment 16 may then be defined by one or more side walls 76. The illustrated storage compartment 16 is accessed by lifting or pivoting a lid 80. Storage compartments of other embodiments may be accessed through an open front, rear, or side. Doors, covers, or hatches may provide selective access to the storage compartment 16 through the front, rear, or side thereof instead of through the top.

In an embodiment, shown in FIG. 5, the lid 80 is configured to removably cover the storage compartment 16 while a top surface 82 of the lid is capable of supporting the weight of a user as part of the seating area 12. The lid 80 is designed to cover the storage compartment 16 and have sufficient strength of its own, such that sitting upon the lid will not collapse the lid into the storage compartment below. In some embodiments, the top surface 82 of the lid 80 is contoured for comfort as a seat. For example, when covering the storage compartment 16, a first end of the lid 80 positioned toward the bow may be higher relative to the water than a second end of the lid located toward the stern. In some embodiments, as shown in FIG. 4, an optional seat cushion 84 and a seat back 86 may be attached to the lid 80, the shell 20, or both.

One preferred aspect of the seating area 12 is to provide a seat at a raised height compared to the standing zones 14. The relatively raised position of the seating area 12 has at least two benefits. First, the raised seating area 12 reduces the bend in a user's knees while sitting. As a result, users should be able to more easily switch from a standing position to a seated position, and vice versa, when the seating area 12 is elevated relative to the one or more standing zones 14. Second, the elevation of the seating area 12 relative to the standing zones 14 also creates elevation between the seating area and the surface of the water. The elevation of the seating area 12 relative to the water provides increased leverage for a user while paddling in a seated position.

In the illustrated embodiment, as seen in FIG. 5, the distance D1 between uppermost portion of the top surface 82 of the lid 80 (or the top surface of a seat bottom, if the storage compartment 16 is accessed from a direction other than the top) and the plane of the mid-ship standing zone 52 preferably ranges from about three inches to about twelve inches. Distances outside of the preferred range are also possible. The distance D1 may be determined based upon the balance of the watercraft 10, including factors such as the length of the watercraft and other performance characteristics, such as maneuverability, speed through the water, and stability.

As shown in FIG. 4, an imaginary reference plane may correspond with the waterline W that circles the shell 20 when the watercraft 10 is floated on water without substantial cargo and without the weight of a user. The distance D2 from the top of the lid 80 to the plane of the waterline W may range from about three inches to about fifteen inches. In another embodiment, the seating area 12 is elevated relative to the remainder of the watercraft 10. For example, a plane P, parallel to the waterline W and intersecting the highest portion of the top surface 82 (FIG. 5) of the lid 80 may not intersect the shell 20 at the front end 32 or the rear end 36.

Further, unlike the generally continuous hull surface a typical SUP, as shown in FIG. 2, the bottom hull 24 of the watercraft 10 combines features of a SUP hull and a sit-on-top kayak hull. A V-bow keel 87 blends toward the rear end 36 into a flat run out 88 adjacent to the stern. The V-bow keel 87 maintains definition through the middle of the watercraft 10 to aid with tracking and hull structure. Stability is provided by outer ribs 89 creating respective pontoon-like volumes. By maintaining an outer envelope that is fairly flat in overall shape, the bottom hull 24 provides initial stability along with ample volume for predictable secondary stability.

To appeal to a more traditional kayak user, such as a kayak fisherman with significant equipment needs on the water, the watercraft 10 may include additional features absent from conventional SUPs. For example, as shown in FIG. 3, the top deck 28 may include an integral cup holder 90 located forward of the seating area 12.

Figure 6:
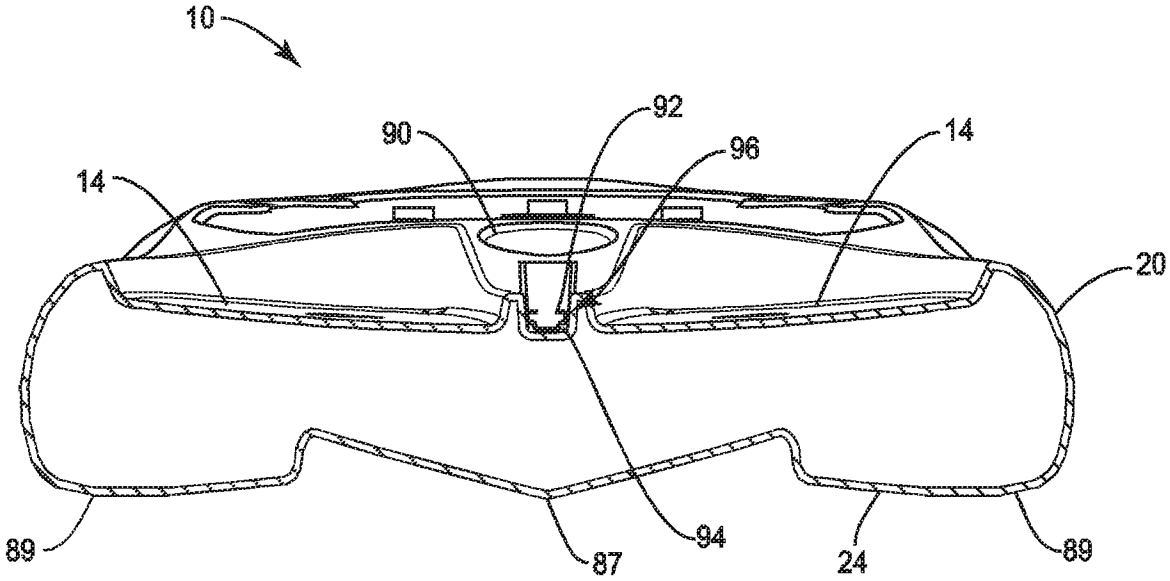
FIG. 6 is a cross sectional view of the watercraft of FIG. 1 along line M in FIG. 3.

For use when mounting additional accessories to the watercraft 10, a rail 92 may be mounted to the top deck 28 of the shell 20. The rail 92 may be an extruded aluminum profile such as the SlideTrax™ system available from Wilderness Systems. As shown in FIG. 6, the top deck 28 of the watercraft 10 may include a recess 94 extending along the center line C. The recess 94 is suitable for receiving the rail 92. The recess 94 may have a first portion 96 having a first depth and a first width sized and dimensioned to mirror a height and a width of the rail 92. A second portion 98 of the recess 94 may have a second depth greater than the first depth and a second width greater than the first width such that when the second portion of the recess receives the rail 92, the segment of the rail corresponding with the second portion of the recess is configured for use as a handle due to the clearance 100 below the rail 92 as shown in FIG. 5. The second portion 98 of the recess 94 may be proximate to the midline M of the watercraft 10 to position the handle near the center of mass of the watercraft.

In addition to the handle provided by the combination of the rail 92 and the recess 94, a bow handle 104 and a stern handle 106 may also be included along the top deck 28 of the watercraft 10. The bow and stern handles 104, 106 can further facilitate portage of the watercraft 10.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A watercraft, comprising:

a shell having a bottom hull, a top deck, a bow, and a stern, a storage compartment integrally formed with the top deck of the shell;

a seating area provided above the storage compartment;

a first standing zone formed on the top deck adjacent to the seating area and located toward the bow relative to the seating area, the first standing zone defining a first plane, wherein the top deck further comprises a second standing zone located toward the stern relative to the seating area, a rear edge of the second standing zone that is substantially level with an adjacent portion of a gunwale of the watercraft such that the second standing zone is capable of use as a swim deck, a front edge and a pair of side edges of the second standing zone are adjacent to upwardly extending side walls, wherein the first standing zone is not a floor of a well, wherein the seating area is raised relative to the first plane.

2. The watercraft of claim 1, wherein the top deck further comprises a third standing zone adjacent to the bow.

3. The watercraft of claim 2, wherein with respect to a top view of the watercraft, a total area of the first standing zone, second standing zone, and third standing zone comprise at least 50% of the footprint of the top deck.

4. The watercraft of claim 3, wherein neither the second standing zone nor the third standing zone is a floor of a well.

5. The watercraft of claim 3, wherein at least one of the first, second, and third standing zones is covered by a traction pad.

6. The watercraft of claim 1, wherein in a side view thereof, a height of the shell is less than ten inches when measured at a location twelve inches inward from each of the bow and stern.

7. The watercraft of claim 1, wherein the top deck of the shell comprises an integral cup holder forward of the storage compartment.

8. A watercraft comprising:

a shell having a bottom hull, a top deck, a bow, and a stern, a storage compartment integrally formed with the top deck of the shell;

a seating area provided above the storage compartment;

a first standing zone formed on the top deck adjacent to the seating area and located toward the bow relative to the seating area, the first standing zone defining a first plane, wherein the first standing zone is not a floor of a well, wherein the seating area is raised relative to the first plane, wherein the top deck of the shell comprises a recess extending along a center line of the watercraft, wherein the recess receives a rail suitable for mounting accessories to the watercraft.

9. The watercraft of claim 8, wherein the recess comprises a first portion having a first depth and a first width sized and dimensioned to corresponding with a height and a width of the rail, wherein the recess comprises a second portion having a second depth greater that the first depth and a second width greater than the first width, such that when the second portion of the recess receives the rail, a segment of the rail corresponding with the second portion of the recess is considered for use as a handle.

10. A watercraft comprising:

a shell having a bottom hull, a top deck, a bow, and a stern, a storage compartment integrally formed with the top deck of the shell;

a seating area provided above the storage compartment;

a first standing zone formed on the top deck adjacent to the seating area and located toward the bow relative to the seating area, the first standing zone defining a first plane, wherein the first standing zone is not a floor of a well, wherein the seating area is raised relative to the first plane, wherein at least one fin is detachably mounted to the bottom of the hull without the use of tools.

11. The watercraft of claim 1, wherein the shell comprises a substantially hollow interior.

12. The watercraft of claim 11, wherein the shell is rotomolded.

13. A kayak, comprising:

a substantially hollow shell having a bottom hull, a top deck, a bow, and a stern, a storage compartment integrally formed on the top deck of the shell substantially rearward of a midline between the bow and the stern;

wherein a top surface of the storage compartment is configured for use as a seat, wherein the top surface of the storage compartment is located above a lowest point of a gunwale of the kayak.

14. The kayak of claim 13, wherein the top surface of the storage compartment is formed as part of a lid that is movable to gain access to an interior of the storage compartment.

15. The kayak of claim 13, wherein the top deck comprises one or more standing zones, wherein with respect to a top view of the kayak, a total area of the one or more standing zones comprises at least 50% of the footprint of the top deck.

16. The kayak of claim 15, wherein the top deck does not include a well having a floor providing a standing zone.

17. A kayak, comprising:

a shell having a bottom hull, a top desk, a bow and a stern;

at least a portion of a storage compartment is capable of use as a seat, wherein the top deck comprises one or more standing zones, wherein with respect to a top view of the kayak, a total area of the one or more standing zones comprises at least 50% of the footprint of the top deck, wherein the one or more standing zones define one or more planes respectively, and wherein the top surface of the storage compartment is offset higher than each of the respective planes of the one or more standing zones.

* * * * *